US005396313A

United States Patent [19]

Zoltner et al.

[11] Patent Number: 5,396,313

[45] Date of Patent: Mar. 7, 1995

[54] OUT OF MEDIA DETECTION SYSTEM FOR A ROLL MEDIA FEED APPARATUS

[75] Inventors: John D. Zoltner, Rochester; Henry T. Kremers; Gary A. Kelpin, both of Fairport, all of N.Y.

[73] Assignee: Xerox Corporation, Stamford, Conn.

[21] Appl. No.: 216,380

[22] Filed: Mar. 23, 1994

[51] Int. Cl.[6] ..... G03G 21/00

[52] U.S. Cl. ..... 355/206; 355/310; 242/563

[58] Field of Search ..... 355/206, 310, 309; 242/563

[56] References Cited

U.S. PATENT DOCUMENTS

| | | | |
|---|---|---|---|
| 3,655,283 | 4/1972 | Margulis et al. . | |
| 3,957,369 | 5/1976 | Wirth . | |
| 4,821,974 | 4/1989 | Poehlein | 242/68.4 |
| 4,885,613 | 12/1989 | Kudoh | 355/310 |
| 4,996,556 | 2/1991 | Gray, Jr. | 355/50 |
| 5,040,777 | 8/1991 | Bell et al. | 271/3 |
| 5,134,915 | 8/1992 | Fukano et al. | 355/310 X |
| 5,237,378 | 8/1993 | McEwen | 355/309 |
| 5,257,567 | 11/1993 | Walter et al. | 83/74 |
| 5,267,704 | 12/1993 | Kitamura et al. | 242/72 R |

*Primary Examiner*—R. L. Moses

[57] ABSTRACT

An end of media detection system is provided for a system which unrolls a media supply such as paper from a cylindrical core substrate. One (trailing) edge of the media is attached to the core substrate. As part of the media detection system, a shaft which is positioned within a pair of cradles supports the cylindrical core. One of the cradles houses a plastic slide, which in turn acts vertically on the actuator of a microswitch when the shaft is in place. The weight of the shaft and media roll acting on the microswitch keeps the microswitch in an inactive state, however, as the media on the roll is played out, at some point just before the media is exhausted the shaft is moved upward due to the adhesive attachment of the trail edge of the media to the core substrate. Movement of the shaft relieves the pressure on the actuator of the microswitch thereby actuating the microswitch to send a signal to a controller to stop rotation of the shaft. This prevents a situation where the sheet still attached to the core stalls at the end of media feed.

12 Claims, 3 Drawing Sheets

OUT OF MEDIA DETECTION SYSTEM FOR A ROLL MEDIA FEED APPARATUS

BACKGROUND AND MATERIAL DISCLOSURE STATEMENT

The present invention relates to a roll media feed apparatus for us in, for example, a copier, plotter or printer environment and more particularly to a detection system which provides an indication that the roll media supply is near exhaustion.

Various image recording systems enable a paper feeding function by feeding paper from a roll and cutting the paper into desired lengths upstream of the paper feed station. Typically, the media (paper, vellum, etc.) is wound about a core which supports the media and permits the media roll to be unwound and sheets are cut therefrom. A conventional sheet handling apparatus unrolls the media from the supply roll and advances a selected length to the sheet cutter station. A machine control system integrates and synchronizes operation of the feeding and cutting system as well as the overall machine operation.

A problem of prior art roll media type systems relates to conditions which arise when the media runs out and is exhausted from the supply roll. Typically, the trail edge of the roll media is actually glued to its cardboard tube core. This poses a threat of damaging or stalling the registration and feeding hardware if the cardboard tube were to be pulled up into the bypass area of the machine. Also, as the roll unwinds and reaches the end of the supply, the media advance is halted and a stalling condition occurs. The stalling can occur at any point along the path of the media including stations where an image is transferred to the media and/or fused. The stalling action can result in damage occurring to, for example, a fuser roll applicator where stripper fingers are used to detach the media from the fuser roll. If the media is stalled, the stripper fingers tend to score the surface of the roll, a condition referred to in the art as "skiving". Continued skiving leads to failure of and replacement of the fuser roll.

One prior art effort to solve this out of media problem is disclosed in U.S. Pat. No. 4,885,613. Disclosed therein is a roll media supply system where an end of media is detected by means of a sensor arrangement shown in FIGS. 3C and described in Col. 4, lines 45–69. An arm 61 rides along the surface of media roll 11. Arm 61 is mechanically coupled to a pivotable plate 64 whose instant position is a function of the roll 11 diameter. Plate 64 overlies a group of five sensors S11. As the diameter of roll 11 is reduced during operation as the media unrolls, successive sensors are exposed to light until a last sensor associated with the end of media provides a signal indicative of such playout. The signals from the last sensor are used to switch operation from the roll media nearing playout to another roll media which has additional remaining paper. Additional signals are generated to control the sheet cutting operation. If all media rolls are exhausted, a copy operation inhibition signal is generated (col. 17, lines 39–60). This type of solution can be characterized as a "low media" remedy; additional media may still be available for copier purposes.

Another solution is embodied in a detection circuitry within the Xerox 3050 large document copier. This machine transfers developed images onto a media such as plain paper or vellum supplied from one of three rolls. Each roll has an encoder coupled to the media roll shaft. The encoder, and related logic, monitor encoder transitions at sample time periods. An increase in the number of transitions per selected time period provides an indication that the media supply is running low but it is not precisely enough to warrant halting copy operations since 10–20 feet of media may still be available for copying purposes and operation typically continues. The above-mentioned solutions do not completely solve the problem since lifting of the media core into the bypass area could still occur.

SUMMARY OF THE INVENTION

It is, therefore, an object of the present invention to monitor the media roll runout in such a way that a signal is generated halting machine operation at a time just before the end of media on a roll is reached. This solution would allow the media to be usefully and optimally consumed to a time just before the end of media condition occurs. The invention contemplates an inexpensive means to electrically interlock a removable shaft which must stay positioned during normal machine operation. In particular, a simple sheet metal shaft holder or cradle, houses a molded plastic slide, which in turn acts vertically on the actuator of a microswitch when the shaft is in place. The weight of the shaft and media is supported fully by the slotted sheet metal cradle, whereas the microswitch is acted upon only by the vertical action of the plastic slide. When the media is about to be exhausted, the shaft will rise due to the media being pulled upward by feed rolls and in turn the slide will be lifted upward by the microswitch thereby actuating the microswitch with the resultant signal going to a controller which stops the machine.

DESCRIPTION OF THE INVENTION

Figure 5:
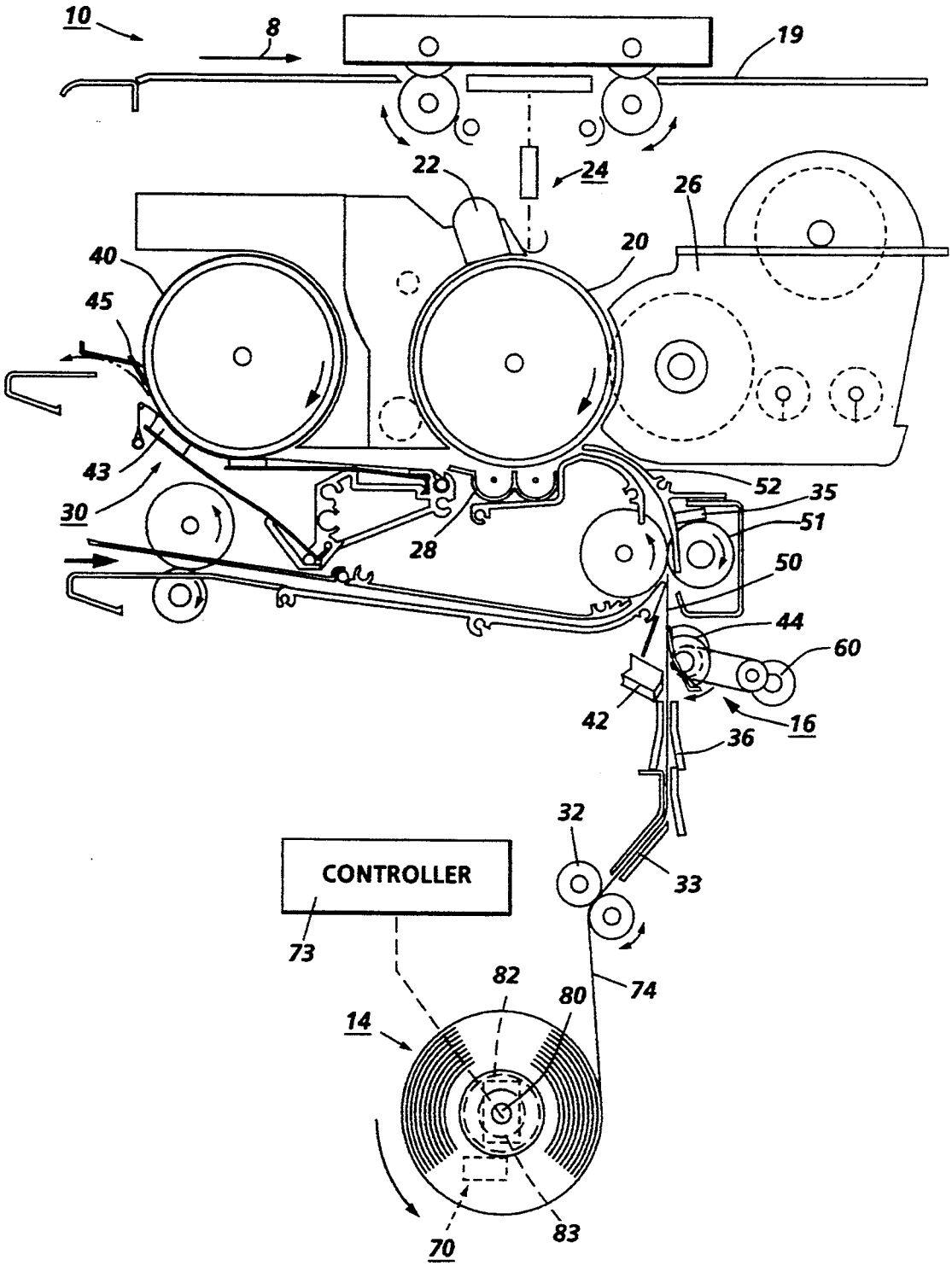
FIG. 5 is an enlarged, partial, side view of an exemplary copier/printer which employs the out-of-media detection system of the present invention.

The out of paper detection system of the present invention is used, for example, in the Xerox® 5320 Copier with its Continuous Paper Feeder and could be used in the: roll feeder of U.S. Pat. No. 5,267,704. Xerox® and 5320 are trademarks of Xerox Corporation. Referring now to the drawings in detail wherein like numbers represent like elements, in FIG. 5 a wide format copier/printer 10 is shown which is especially adapted to copy large documents. Operation of this type of copier is disclosed in U.S. Pat. Nos. 5,237,378 and 5,257,567 whose contents are hereby incorporated by reference. It is understood that the out of media detection system of the present invention can be used in conjunction with other types of apparatus which utilize media which is unrolled from a roll and used for various imaging and marking purposes. Its usage in a copier/-printer 10 is therefore exemplary. Documents to be copied are fed in from the front of the machine in the direction of arrow 8, pass through an exposure zone and exit out of the back of the machine. Print operation is controlled through selection of switches on a conventional control panel (not shown). FIG. 5 shows a side internal view of the copier/printer machine 10. Machine 10 includes an electrostatic drum 20 with xerographic stations arranged around its periphery, which carry out the operational steps of the copying process. These stations include charging station 22, exposure station 24, developing station 26, transfer station 28 and fusing station 30. Documents fed along the platen 19 in the direction of arrow 8 are imaged onto the surface of drum 20, at exposure station 24. The operations of the stations are conventional and are described, for example, in U.S. Pat. Nos. 4,821,974; 4,996,556; and 5,040,777, whose contents are incorporated herein by reference.

Copy media, which may be bond paper, vellum, or the like, is cut from a media roll assembly 14 and is fed by a respective feed roller pair 32 through baffle pair 33 into a paper path. The sheet to be cut is guided along a vertical path between baffle pairs 36 into the sheet cutting bar assembly 16 which includes a stationary blade 42 and a rotating cutting bar 44 that includes a helical cutting blade. Cutter bar 44 is shown in the home position which is about 30° of rotation away from the cutting position and is driven by motor 60. Initiated by a cutter operation signal, bar 44 rotates in the direction of the arrow with its blade moving against blade 42 to shear a sheet 50 from the roll media with a straight cut. The cut sheet is transported by roller pair 51 into baffle 52 and then into transfer station 28 where a developed image is transferred onto the sheet. The cut sheet is then forwarded through fuser station 30 and out of the machine. Fuser station 30 includes a fuser roll 40 and a web member 43 which cooperate to form a fusing area for media passing therebetween. The media is detached from the fuser roll 40 surface by a plurality of stripper fingers 45.

Figure 4:
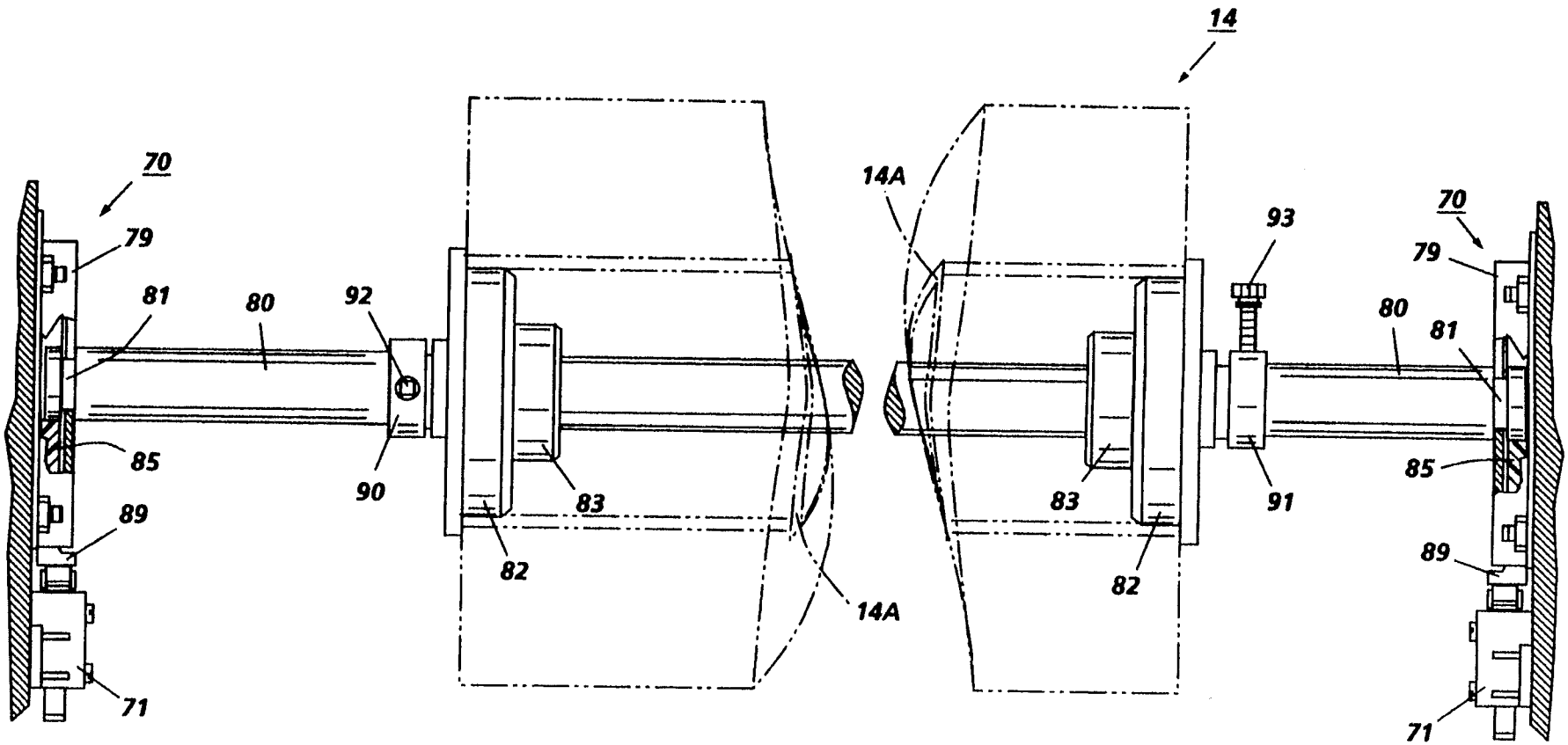
FIG. 4 is an elevational view of a shaft and media roll assembly mounted on out of media detection switches of the present invention.

Turning now to consideration of the media roll assembly 14 of FIGS. 4 and 5, the assembly includes a core substrate 14A mounted on shaft 80. Affixed along the length of substrate 14A is the trailing edge of a roll media supply which, for this example is plain paper. The paper may be glued along the substrate surface or affixed in any preferred manner. Affixing the trail edge of the media is preferred for most roll system since it facilitates the task of winding the paper around the core substrate. It will be appreciated that as the roll 14 unwinds during operation at some point the media will be "played out"; e.g., completely unrolled. The media at some point will be stretched taut from the roll and lifting of the shaft by the pull of the feed rolls 32, in FIG. 5 unless prevented, stalling would occur thereby enhancing the possibility of damaging the registration feeding mechanisms and fuser. According to the principles of the present invention, a simple concept for ensuring a customer removable supply roll shaft is always properly supported in its cradle so as to prevent damage to mechanism of the machine includes a microswitch 71 that is movably connected to shaft 80. The microswitch senses upward movement of the shaft and sends a signal to a conventional controller 73 of the machine which in turn stops rotation of the shaft.

Figure 1:
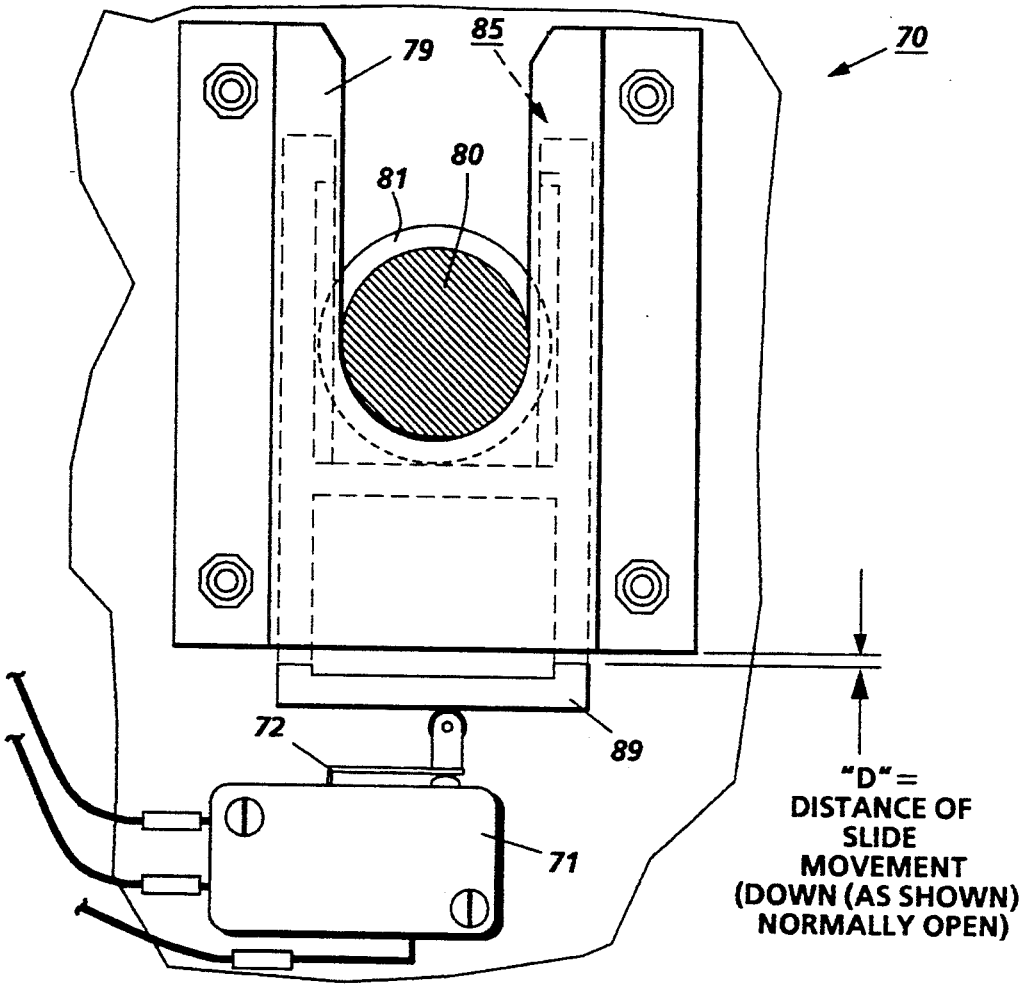
FIG. 1 is an enlarged, partial, front view of the out of media detection system of the present invention.
Figure 2:
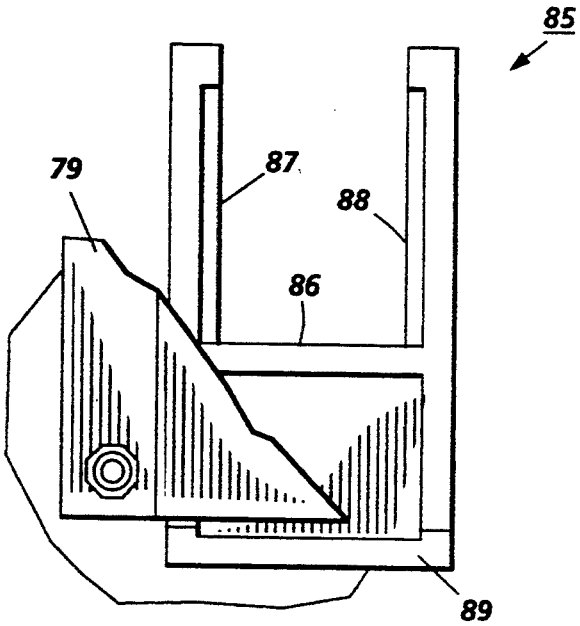
FIGS. 2 and 3 are front and side views, respectively, of the slide mechanism of the present invention.
Figure 3:
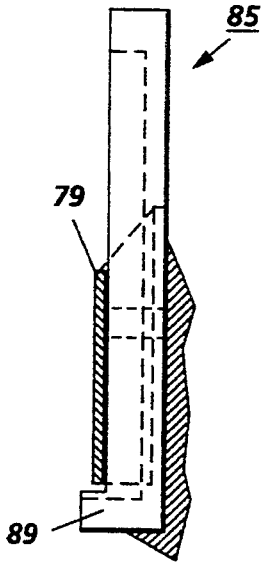

The end of media detection system 70 in FIGS. 1 through 3 provides a means to cost effectively interlock a shaft support with a safety switch and preferably comprises sheet metal roll holders or cradles 79 with U-shaped, slotted portions that support either or both ends of media supply roll shaft 80 of FIG. 4. The shaft 80 contains an under cut slot 81 at either end which engages the U-shaped, slotted cradle portion of roll holder 79. A plastic slide 85 shown in FIGS. 2 and 3 resides within the cradles. The slide 85 has a portion thereof 86 that contacts the major outside diameter of the roll shaft and is configured to include a U-shaped portion that comprises two legs 87 and 88 which facilitate a no-bind, vertical sliding action in use and a flange 89 at the bottom for contacting actuator 72 of microswitch 71. Microswitch 71 is positioned beneath the slide when the slide is placed within a particular cradle and changes state when the shaft 80 is lifted out of the cradle. The switch actuator 72 is protected from excessive override by the shaft-slide through an adjustment slot (not shown) engaged by one of the switch mounting screws.

In FIG. 4, a roll of media is shown mounted on roll supports or hubs 82. Roll supports 83 are to be used with smaller diameter cores. A pair of collars 90 and 91 stabilize and fixedly positions the roll supports 82 on shaft 80 with a set screw 93 in one of the collars and a thumb screw 94 in the other. The thumb screw facilitates customer replacement of expended media cores with a fresh roll of media. Undercut slots 81 at each end of shaft 80 permits easy insertion of thee shaft into cradles 79 and also precisely positions the outside diameter of the shaft against slide 85.

It should now be apparent that an end of media detection system has been disclosed that is extremely robust and free of malfunction and provides an inexpensive means to electrically interlock a removable shaft which must stay positioned during normal machine operation. The apparatus includes a slotted sheet metal shaft cradle that houses a molded plastic slide which in turn acts vertically on the actuator of a microswitch as the slide is pressed against the actuator by a shaft which supports roll media. The weight of the shaft and paper is supported fully by the slotted sheet metal cradle, whereas the sensitive switch is acted upon only by the vertical action of the plastic slide. The end of media detection system includes unique features of compact size, total captivity of the slide, near perfect reliability, and excellent cost effectiveness.

While the embodiment disclosed herein is preferred it will be appreciated from this teaching that various alternative modifications, variations or improvements therein may be made by those skilled in the art which are intended to be encompassed by the following claims:

What is claimed is:

1. An end of media detection system for a media roll feeding apparatus comprising:

a media roll mounted on a rotatable shaft, sensing means positioned beneath and in contacting relationship with said shaft for sensing vertical movement of said shaft during media feed operation and for generating a signal indicative of the vertical movement of said shaft, and controller means for receiving said signal from said sensing means and generating a signal to stop operation of said roll feeding apparatus.

2. The end of media detection system of claim 1, wherein one end of said shaft is supported in a cradle member having a slotted, U-shaped portion.

3. The end of media detection system of claim 2, including a slide member positioned within said cradle member and adapted for vertical movement within said slotted, U-shaped portion of said cradle member.

4. The end of media detection system of claim 3, wherein said slide member includes a planar base portion.

5. The end of media detection system of claim 4, wherein said sensing means comprises a microswitch, said microswitch have an actuator member that contacts and is depressed by said planar base portion of said slide member when said shaft is positioned within said cradle.

6. In a document reproduction machine wherein documents are imaged onto a photosensitive medium to form a latent image and wherein said latent image is developed and transferred to an output sheet which is roll fed from a media roll and cut into appropriate length by sheet cutting means, the improved end of media detection system, characterized by: sensing means for detecting when the media supply is near exhaustion from the media roll, said sensing means comprising a microswitch means for generating a signal representing vertical movement of a shaft on which the media roll is mounted; and controller means for monitoring said microswitch means output and for generating an end of media signal to stop the reproduction machine just before the end of the media supply is reached.

7. An improved media supply apparatus comprising:

a media roll structure including a core substrate mounted on a rotatable shaft;

a media supply having one edge fixedly attached to said roll core substrate, the supply wound about the core substrate to form a media supply roll;

means for unrolling the media from the supply roll and advancing the media along the paper path until an end of media condition is reached when the media is almost exhausted;

the improvement wherein the apparatus further comprises sensing means coupled to said rotatable shaft, said sensing means generating a signal upon non-rotational movement of said shaft and further includes controller means for receiving the signal from said sensing means and for generating an approaching end of media signal which stops rotation of said shaft.

8. The end of media detection system of claim 7, wherein one end of said shaft is supported in a cradle member having a slotted, U-shaped portion.

9. The end of media detection system of claim 8, including a slide member positioned within said cradle member and adapted for vertical movement within said slotted, U-shaped portion of said cradle member.

10. The end of media detection system of claim 9, wherein said slide member includes a planar base portion.

11. The end of media detection system of claim 10, wherein said sensing means comprises a microswitch, said microswitch have an actuator member that contacts and is depressed by said planar base portion of said slide member when said shaft is positioned within said cradle.

12. A method for detecting an end of media condition in a media feed roll system comprising the steps of:

providing a feed roll support structure;

providing a shaft adapted for mounting in said feed roll support structure for rotation in a first direction and further movement in a second direction;

mounting the media roll on said shaft with said shaft being supported by said support structure;

unrolling the media from the support feed roll structure at a controlled speed, monitoring said shaft to detect any movement of the shaft in said second direction which would be associated with an approaching end of media condition; and generating an end of media signal upon detecting said movement of said shaft in said second direction to stop rotation of said shaft.

* * * * *